United States Patent [19]

Christenson

[11] Patent Number: 4,656,800

[45] Date of Patent: Apr. 14, 1987

[54] METHOD AND CONSTRUCTION OF A CISTERN FROM COMPONENT BLOCKS AND REINFORCING RODS

[76] Inventor: Thomas B. Christenson, 252-29 72nd Ave., Bellerose, N.Y. 11426

[21] Appl. No.: 901,284

[22] Filed: Aug. 28, 1986

[51] Int. Cl.[4] ..... E04B 1/04; E04B 1/35; E04G 15/00

[52] U.S. Cl. ..... 52/248; 52/302; 52/414; 52/606; 52/743; 264/32; 264/263; 264/267

[58] Field of Search ..... 52/20, 21, 248, 270, 52/302, 303, 405, 414, 505, 606, 743, 747; 264/32, 263, 267

[56] References Cited

U.S. PATENT DOCUMENTS

| | | | |
|---|---|---|---|
| 767,398 | 8/1904 | Ferguson | 52/248 |
| 777,073 | 12/1904 | Brownson | 52/606 |
| 798,850 | 9/1905 | Weber | 52/248 |
| 894,122 | 7/1908 | Dougherty | 52/270 |
| 1,050,130 | 1/1913 | Harvey | 52/248 |
| 1,154,219 | 9/1915 | Straight | 52/302 |
| 1,277,556 | 9/1918 | Dochnal | 52/248 |
| 1,485,309 | 2/1924 | Steward | 52/303 |
| 1,727,546 | 9/1929 | Knapen | 52/302 |
| 2,153,913 | 4/1939 | Blackwell | 52/505 |
| 2,198,399 | 4/1940 | Tefft | 52/606 |
| 3,386,217 | 6/1968 | Couture | 52/303 |

FOREIGN PATENT DOCUMENTS

| | | | |
|---|---|---|---|
| 967968 | 11/1950 | France | 52/606 |
| 2062062 | 5/1981 | United Kingdom | 52/606 |

*Primary Examiner*—John E. Murtagh
*Assistant Examiner*—Caroline D. Dennison
*Attorney, Agent, or Firm*—Collard, Roe & Galgano

[57] ABSTRACT

A cistern made of layers of arcuate blocks provided with openings in which reinforcing rings and rods are deposited, the openings being arranged such that mortar can be spread throughout the structure to form a monolithic construction. Wedge-shaped openings are formed in the blocks in radial disposition and removable wedges are placed therein to form permanent openings in the construction, the wedges being removed after the mortar has set. Metal circular rings are also placed on each leg or block and each of the rings are coupled together by vertical depending rods before the cement is forced through the hollow openings of the layers of arcuate blocks.

14 Claims, 5 Drawing Figures

INVENTOR
THOMAS CHRISTENSON

METHOD AND CONSTRUCTION OF A CISTERN FROM COMPONENT BLOCKS AND REINFORCING RODS

This invention relates to a method and construction of manufacturing a cistern from component arcuate blocks at a building cite.

More specifically, this invention relates to a method and construction of manufacturing a cistern using preformed structurally rigid blocks such as concrete blocks which are hollow in construction and when placed in a cylindrical mode, are capable of receiving circular reinforcing rings which are coupled together with hooked rods and form a rigid monolithic construction when concrete is poured into the hollow openings of the preformed blocks.

BACKGROUND OF THE INVENTION

Cisterns are conventionally and commercially manufactured at a plant in one large monolithic structure normally requiring transportation by means of a large truck or the like to the location at which the cistern is to be installed. This transportation exposes the cistern to the hazards of breakage or damage while at the same time requiring heavy equipment for purposes of loading and unloading. Moreover, where such cisterns are cast as a one-piece unit, problems of stresses arise which sometimes result in inherent weaknesses. Certain proposals have been made for purposes of fabricating cisterns from sub-units or sub-assemblies which are transported as such to the location where they are to be installed. These techniques for various reasons have never found large commercial application.

PRIOR ART

There are numerous patents in the prior art which illustrate the construction of monolithic structures using circular blocks which are reinforced. Such patents include the patent to Dochnal, U.S. Pat. No. 1,277,556. Hollow building blocks have also been disclosed in the patent to Steward, U.S. Pat. No. 1,485,309. Other patents showing building block construction using hollow blocks with and without reinforcing means include U.S. Pat. Nos. 1,050,130 to Harvey; 3,386,217 to Couture; 1,727,546 to Knapen; 1,154,219 to Straight; 2,198,399 to Tefft; 777,073 to Brownson; 2,153,913 to Blackwell; 767,398 to Ferguson; 798,850 to Weber; 894,122 to Dougherty; UK Patent No. 2,062,062 to Rassias et al and French Patent No. 967,968 to Dargelas.

None of the above patents taken singly or in combination include all of the inventive features such as the use of the wedge-shaped openings including wedges and hooked rods which join annular reinforcing rings contained between the blocks together nor suggest any of the methods of the construction of this invention.

DETAILED DESCRIPTION OF THE INVENTION

It is therefore an object of the invention to provide a new and improved technique for the manufacture of cisterns and the like.

It is a further object of the invention to provide new and improved techniques whereby special and improved concrete blocks are provided which are capable of being formed into a monolithic structure constituting a cistern.

Yet another object of the invention is to provide improved means for the fabrication of a monolithic cistern construction while at the same time providing in such construction the specialized wedge-shaped openings available in conventional cisterns to provide for drainage therefrom while limiting the entry of dirt and other foreign materials into the cistern construction.

In achieving the above and other of the objects of the invention, there is proposed a cistern construction consisting of a plurality of superposed layers of arcuate concrete blocks having communicating openings extending through and between said layers, a bonding material such as mortar being charged into these openings in order to bond the layers into a monolithic structure having a generally cylindrical form.

As a feature of the invention, wedge-shaped openings are provided in and radially disposed with respect to the blocks, these wedge-shaped openings accommodating wedges which are removed after the mortar has set.

According to another feature of the invention, there are employed metal reinforcing rings extending through the respective layers of blocks in generally concentric relationship with the cylindrical form. Moreover, reinforcing rods are provided which extend through the layers in generally axial disposition relative to the reinforcing rings. In accordance with the invention, the aforesaid openings are supplemented by juxtaposed dove-tail shaped openings which are intended to provide for an effective gripping between the mortar and the various blocks.

Other objects and features of the present invention will become apparent from the following detailed description considered in connection with the accompanying drawings, which disclose several embodiments of the invention. It is to be understood that the drawings are to be used for the purpose of illustration only, and not as a definition of the limits of the invention.

In the drawings, wherein similar reference characters denote similar elements throughout the several views.

DETAILED DESCRIPTION OF THE DRAWINGS

Figure 1:
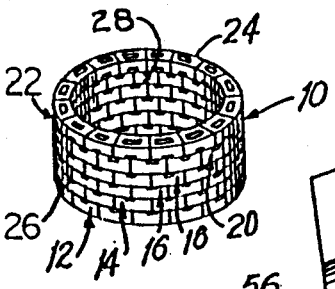
FIG. 1 is a perspective view of a cistern prepared in accordance with the invention.

Referring to FIG. 1, there is shown a cistern 10 having a generally cylindrical form and consisting of a plurality of layers of which layers 12, 14, 16, 18, 20 and 22 are shown by way of example. These layers are superposed upon one another and are each formed of a plurality of blocks such as, for example, block 24. Each block 24, as will be described in greater detail hereinafter, is an arcuate segment susceptible of being combined with a plurality of like blocks to form a circular tier. The blocks of one layer are preferably staggered (in relationship to polar coordinates) with respect to the blocks of the next superposed layer. The blocks of alternate layers are preferably aligned with one another.

As is readily seen in FIG. 1, the cistern is provided with a multitude of openings 26 which are of wedge-shape and which are, per se, conventional. These openings are radially disposed relative to the cylindrical form of cistern and flare outwardly so that drainage from the interior 28 of the cistern is facilitated while entry of the surrounding dirt is minimized due to the tapered walls of the openings.

It will be noted that openings 26 are generally provided in the upper faces of the respective blocks in which these openings are formed. Thus, the side and lower walls of the openings are defined by the block in which the openings are provided, whereas the upper or closing wall of each opening is provided by the bottom wall or face of the next superposed block or blocks.

The arrangement which has been described with respect to openings 26, applies to each of the layers except uppermost layer 22 in which the wedge-shaped openings are provided in the bottom faces of the respective blocks. Actually, these latter blocks are identical in shape and form to the blocks of the lower layers. However, the blocks in the uppermost layer are inverted in order to avoid having upwardly opening wedge-shaped passages in the top edge of the cistern.

Figure 2:
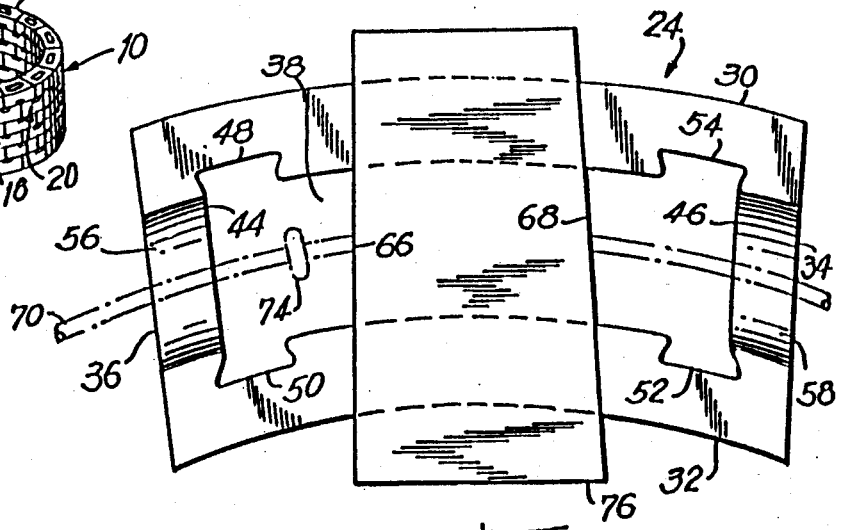
FIG. 2 is a top plan view of a concrete block employed in the cistern of FIG. 1.
Figure 3:
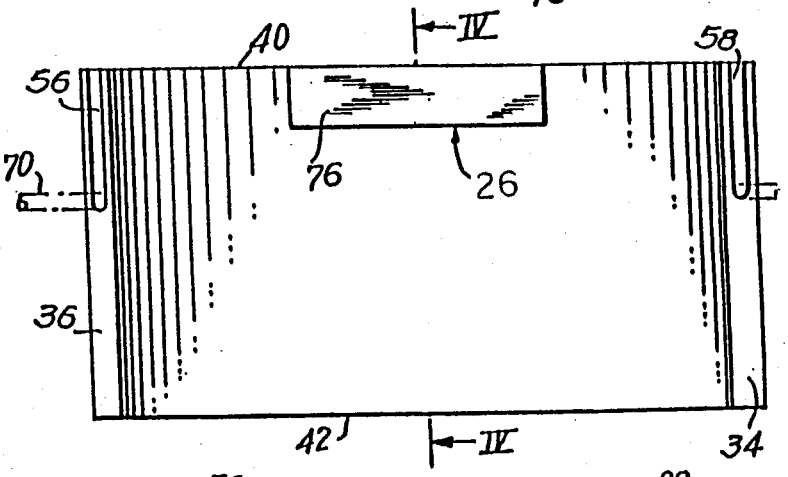
FIG. 3 is a side view of the concrete block of FIG. 2.
Figure 4:
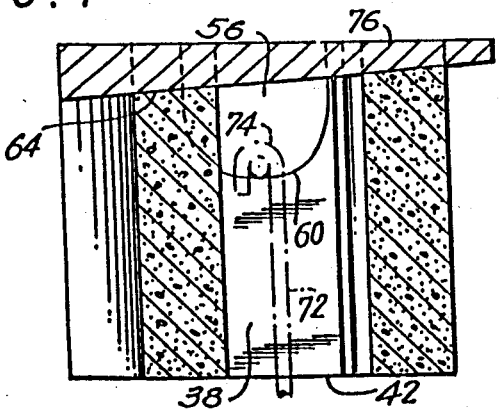
FIG. 4 is a cross-sectional view, taken along line IV—IV of FIG. 3.

An illustrative block of the type employed in the cistern of FIG. 1 appears in detail in FIGS. 2–4. Referring first to FIG. 2, block 24 consists of an outer face 30 and an inner face 32, both of which are arcuately shaped and concentric with one another. These faces are similarly concentric with the axis of the cistern constructed from the related blocks.

Block 24 is also provided with end faces 34 and 36. These faces are preferably planar, and are also preferably tapered so as to be radially disposed with respect to the finished cylindrical form.

Block 24 is provided with a vertical opening 38 extending completely therethrough from the top face of the block to the bottom face thereof, said faces being indicated at 40 and 42 in FIG. 2.

Opening 32 is generally of arcuate shape extending between end faces 34 and 36 of the block but being spaced from the latter. As a feature of the invention, there is provided adjacent ends 44 and 46 of said vertical opening supplemental openings 48, 50, 52 and 54. These latter openings are dove-tail shaped openings and are intended to provide a most effective gripping of the mortar as will be explained hereinafter.

Further openings 56 and 58 are provided in the ends of the block and communicate vertical opening 38 with the block ends. As is seen more particularly in FIG. 4, these latter openings do not extend completely through the block in a vertical sense, but have rounded bottoms 60 which are spaced from bottom face 42 of block 24 (see FIG. 4).

Centrally located in each block 24 is a wedge-shaped opening 62 having a sloping bottom wall or face 64 and two tapered side faces 66 and 68. This wedge-shaped opening 26 is freely open at the top of the block and is intended to accommodate a wedge to substantially fill the space, as will be subsequently explained.

Blocks 24 are preferably fabricated of concrete, but other similar materials having suitable structural strength can be substituted if found convenient. The blocks are preferably of a size which renders them portable so that they can be manually loaded and unloaded from the transportation vehicle employed. It will therefore be readily appreciated that these blocks can be manufactured at a suitable plant provided for their fabrication and then transported unassemblied to the location at which the cistern is to be installed. These products can then be combined into cistern form and processed as will be hereinafter described, whereupon a complete cistern will be formed having the strength of a monolithic structure.

In order to provide a suitable physical strength for the resulting structure, as each layer of blocks is installed, a steel reinforcing ring 70 is inserted at the top of each layer, this ring extends through openings 56 and 58, below bottoms 64 of the various wedge-shaped openings 26. Ring 70, which can also be fabricated of any other metal or material having suitable structural strength, is supported on bottoms 60 of the various openings 56 and 58. These rings will be generally disposed in concentric relationship with the axis of the cistern being manufactured and a plurality of such rings will be employed, one for each layer of blocks except the uppermost layer.

In addition to the metal reinforcing rings 70, there are also provided a plurality of vertical reinforcing rods 72, each provided with a hooked upper extremity 74 which is preferably hooked over the uppermost ring 70 and suspended therefrom in depending relationship. At least one such reinforcing rod is preferably employed with each vertical alignment of openings 38, but two or more of such vertical reinforcing rods can also be employed as required.

When rings 70 and rods 72 have been installed in superposed layers, the next step in the construction of the cistern is the insertion of wedges 76 into the wedge-shaped openings 26. Wedges 76 are preferably fabricated of wood or a like inexpensive material capable of being used repeatedly and capable of withstanding mallet blows as will hereinafter be explained. Wedges 76 are moreover preferably lubricated with a heavy oil or the like, or with a conventional material capable of inhibiting the setting of the immediately surrounding mortar. Such materials are well known in the art and require no explanation in this text.

After the wedges are installed, and assuming that the reinforcing rings and rods have already been positioned, mortar is then charged through the uppermost of the vertical openings 38 in the assembly and is allowed to descend through the network of communicating openings which have been formed until the entire honeycomb has been filled with mortar which extends into the dove-tail openings described above. The mortar will pass through the various openings 38 and through communicating openings 56 and 58 so that the mortar in combination with the concrete blocks will form a monolithic structure through which will extend the rings 70 and rods 72.

After a suitable curing time, the mortar will have set and openings 38, 56 and 58 will have been completely filled with the cured mortar. At this time, blocks 76 are hammered out of the wedge-shaped openings 26 whereupon these openings will be permanently available for the drainage of fluid from within the cistern. Thus, the wedge-shape has two important aspects to it, notably that of facilitating the removal of wedges 76, while at the same time providing for the tendency of unidirectional movement of materials therethrough since drainage from inside of the cistern will be facilitated whereas the movement of dirt and other such materials into the cistern will be impeded due to the sloped walls of these openings.

While the wedges are removed and can be subsequently used in the fabrication of further cisterns, rings 70 and rods 72 remain in place thereby contributing to the physical strength of the resulting cistern and providing further surfaces on which the mortar may attach.

The result is an extremely strong construction which is as durable, if not more so, than previously known cisterns which are made in entirety at a plant provided for such purpose.

While openings 56 and 58 have been illustrated in rectilinear coaxial alignment, it is possible to arrange these openings in arcuate concentric relationship provided that the cost of manufacture will not be too greatly increased thereby. Similarly, the dove-tail shaped openings which have been illustrated can be distributed with greater or lesser frequency through the concrete blocks according to the needs of the construction.

While wedge-shaped openings have been illustrated in each of the layers of blocks, it might be possible to eliminate these in alternate of the layers or to provide additional wedge-shaped openings if increased drainage is necessary. Similarly, while the inverted arrangement of blocks at the top of the cistern is to be preferred, this layer can be eliminated if, for any particular use, the presence of upwardly opening wedge-shaped slots is not objectionable.

While it is not found generally necessary to supplement the force of gravity for purposes of spreading the mortar throughout the system of communicating openings in the cistern, it should be noted that it is possible in certain instances to employ vibrating equipment as is conventional in the art to provide for insuring against voids or the like when the mortar is inserted. Usually, however, it will be possible to provide the mortar in such consistency that its flow throughout the honeycomb of openings will be complete without such auxiliary treatment which can therefore be omitted.

It will be appreciated that the mortar represents one type of bonding material including, by way of example, cement and cementitious products, the chief requirement for such material being that it have suitable structural strength so that the various blocks can be readily held together.

Figure 5:
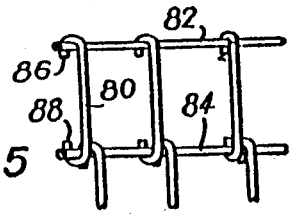
FIG. 5 illustrates a modification of one of the elements illustrated in FIG. 4.

There will now be obvious to those skilled in the art many modifications and variations of the construction and techniques set forth hereinabove. These modifications and variations will not depart from the scope of the invention if defined by the following claims. One such modification appears in FIG. 5 wherein rod 72 of FIG. 4 is replaced by individual rods 80 extending between adjacent layers (e.g. rings 82 and 84) and provided with upper and lower hooks 86 and 88.

What is claimed is:

1. A method of building a cistern comprising the steps of:

forming a plurality of arcuate shaped blocks with vertical and horizontal openings extending therethrough, wherein each of said blocks includes at least one wedge-shaped slot formed in a horizontal face of the block and disposed radially with respect to the block;

juxtaposing the blocks in circular horizontal layers on which the horizontal openings are aligned;

depositing the reinforcing rings in the horizontal openings, the layers being superimposed to form a cylinder;

depositing reinforcing rods vertically in the vertical openings of said arcuate shaped blocks, placing wedges in the slots of said wedge-shaped slots to substantially fill the space of said wedge-shaped slot; and charging the openings of said arcuate shaped blocks with mortar to bind the blocks together and form a monolithic structure.

2. The method as recited in claim 1, additionally comprising the step of removing the wedges after the mortar has at least partially cured to leave tapered openings therein which flare outwardly with respect to the cylinder.

3. The method as recited in claim 2, wherein said wedges are wood and are lubricated prior to the adding of the mortar.

4. The method as recited in claim 3, wherein said step of depositing reinforcing rods additionally comprises the step of forming hooks in the vertical rods and hooking the rods over one of the rings in order that the rods be suspended from the rings.

5. The method as recited in claim 4, wherein said step of juxtaposing the blocks additionally comprises the step of staggering the preformed arcuate blocks in one layer with respect to those of the next superimposed layer and further providing dove-tailed shaped openings in communication with the vertical openings to improve the gripping of the mortar.

6. The method as recited in claim 5, wherein the wedge-shaped openings are formed in only one horizontal face in each of said blocks, and comprising placing the blocks of all layers except the uppermost layer so that the wedge-shaped openings are upwardly disposed, and inverting the uppermost layer of blocks so that the cylinder has a flat upper edge.

7. The method as recited in claim 6, wherein the vertical and horizontal openings in each block are in intersecting relation comprising forming the horizontal opening such that the end extremities thereof are open outwardly.

8. The method as recited in claim 1, comprising vibrating the cistern to pack the mortar.

9. A cistern construction in the form of a cylindrical monolithic structure comprising:

a plurality of superimposed layers of like arcuate concrete blocks having communicating openings therewith extending through and between said layers, said openings extending both horizontally and in a vertical direction;

wedged-shaped openings opened outwardly toward the superimposed layers and extending radially through each of said blocks along at least one horizontal surface thereof;

at least one annular reinforcing ring disposed in interconnecting relationship and extending through the blocks of each of said layers in generally concentric relation with said cylindrical form; and reinforcing rods extending through the vertical openings of said blocks in a generally axial disposition relative to said rings, said rods having hook-shaped upper extremedies hooked over the uppermost reinforcing ring, so that when mortar is charged through the openings of each of said blocks, the mortar will bind the blocks, reinforcing rods and reinforcing rings together to form a monolithic structure.

10. The construction as recited in claim 9, wherein said reinforcing rods additionally include lower hooks engaging the lower annular rings of separate layers of blocks.

11. The construction as recited in claim 9, wherein said blocks have planar upper, lower, and end faces, and concentric inner and outer arcuate faces, each block being provided with a generally arcuate shaped opening extending vertically and completely therethrough but spaced from the end, and arcuate faces, each block being further provided in the upper face thereof with open troughs communicating with the arcuate shaped opening and open at the end faces of the block, dove-tail shaped openings being provided adjacent the arcuate opening for the penetration of said bonding material to assure an effective gripping between the latter and the block.

12. The construction as recited in claim 11, wherein the wedge-shaped openings in the blocks of all of the layers except the uppermost layer open upwardly towards the superposed layers and the wedge-shaped openings in the blocks of said uppermost layer open downwardly.

13. The construction as recited in claim 9, additionally comprising wedge-shaped blocks for insertion into said wedge-shaped opening to substantially fill the space within the openings.

14. The construction as recited in claim 13, wherein said wedges are wood blocks having lubricated surfaces for resisting the adhesion of the mortar.

* * * * *